United States Patent [19]

Li

[11] 4,450,997

[45] May 29, 1984

[54] WINDER STRING-UP ASPIRATOR

[75] Inventor: Hsin L. Li, Parsippany, N.J.

[73] Assignee: Allied Corporation, Morris Township, Morris County, N.J.

[21] Appl. No.: 406,663

[22] Filed: Aug. 9, 1982

[51] Int. Cl.[3] ..... B65H 17/32; B65H 51/16

[52] U.S. Cl. ..... 226/97; 226/7

[58] Field of Search ..... 242/18 R, 18 PW, 18 DD; 226/97, 7, 91, 95; 57/350; 28/271, 272, 273, 274, 275, 276, 283

[56] References Cited

U.S. PATENT DOCUMENTS

| | | | |
|---|---|---|---|
| 3,261,071 | 7/1966 | Clendening, Jr. et al. | 28/273 X |
| 3,334,161 | 2/1965 | DeGuzman et al. | 264/24 |
| 3,698,610 | 10/1972 | Feltgen et al. | 226/97 X |
| 3,766,606 | 10/1973 | Piper et al. | 226/97 X |
| 3,802,036 | 4/1974 | Parks | 28/271 X |
| 3,938,583 | 2/1976 | Kavesh | 164/276 |
| 4,052,017 | 10/1977 | Schar | 242/18 DD X |
| 4,142,571 | 3/1979 | Narasimhan | 164/88 |
| 4,239,187 | 12/1980 | Boggs et al. | 242/25 R |

OTHER PUBLICATIONS

Research Disclosure, No. 128, Dec. 1974, pp. 6–7.

*Primary Examiner*—John M. Jillions
*Assistant Examiner*—Scott J. Haugland
*Attorney, Agent, or Firm*—Paul Yee; Ernest D. Buff; Gerhard H. Fuchs

[57] ABSTRACT

This invention provides an aspirator apparatus for the in line string up of a rapidly advancing filament from a continuous forming operation onto a rotating winding wheel. A top aspirator plate is disposed opposite and in facing relation to a bottom plate and is movable relative thereto. An actuator mechanism selectively moves the top plate in a direction normal to the bottom plate to adjust the separation distance therebetween and to selectively delimit an aspiration zone between the top and bottom plates. This aspiration zone has at least one aspirator inlet portion to receive filament, an aspirator outlet portion to exit the filament and an aspirator jet portion to capture, tension and direct the filament. A fluid jet means communicates with the jet portion to provide an aspirating jet of pressurized fluid therein, and a transport means moves the apparatus to effect filament string-up.

9 Claims, 5 Drawing Figures

WINDER STRING-UP ASPIRATOR

DESCRIPTION

BACKGROUND OF THE INVENTION

1. Field of the Invention

This invention relates to an aspirator apparatus for taking up, capturing and transporting a rapidly advancing filament from a continuous forming operation. More particularly, it relates to an aspirator for the string up of such filament onto a winding wheel.

2. Description of the Prior Art

In the production of glassy alloy continuous filaments, typically an appropriate molten alloy is quenched at extreme rates, usually at least about 104° C. per second, by extruding the molten alloy from a pressurized reservoir through an extrusion nozzle onto a high speed rotating quench surface, as is representatively shown in U.S. Pat. No. 4,141,571, "Continuous Casting Method for Metallic Strips", issued Mar. 6, 1979 to M. Narasimhan, hereby incorporated by reference. Such filaments are necessarily thin, typically about 25 to 100 microns, owing to the extreme heat transfer rate required to prevent substantial crystallization, though considerable selectivity may be exercised respecting the transverse dimensions and cross section of the filament. Thus, as used in the specification and claims, the term "filament" is intended to include strips, narrow and wide, as well as wire like filaments.

It is commercially desirable to wind the filament in line with its casting process, as representatively shown in U.S. Pat. No. 3,938,583, "Apparatus for Production of Continuous Metal Filaments", issued Feb. 17, 1976 to S. Kavesh, hereby incorporated by reference. However, initiation of winding in line with the casting process is especially difficult because linear casting speeds are high. To string up the filament in line from the casting process to a winder, the leading portion of the high speed filament must be captured as it departs the rotating quench surface and translated to the winder. String up must be accomplished quickly and precisely, otherwise an entangled mass of filament accumulates rapidly. Also, the tension exerted on the filament during string up must be maintained within limits. Tension must be sufficient to substantially dampen disrupting oscillations of the filament (excessive flutter) but not so much as to disrupt the quenching operation.

It is conventional in high speed filament string up to use an aspirator, whereby the leading portion of the moving filament is drawn through an aspirating nozzle for subsequent translation of the filament to the winder. Conventional aspirators are well known in the textile art, and are used to capture textile yarns and transport them to winders. These aspirators have circular or rectangular cross section inlets and are usually tubular shaped. Pressurized fluid, such as air, provides fluid jets within the tubes which tension and direct the filament through the aspirator. Since textile filaments generally are in a low denier range (15–10,000), and generally quite small relative to the size of the aspirator inlet opening, a tangled filament at the aspirator inlet it is less likely to choke the aspirator and will probably blow right through the aspirator tube.

Metal filament made of glassy metal alloys have a density of 2 to 10 grams per cc, and as a result, have a high denier range (10,000–1,000,000). Because of the high denier range of glassy metal filaments, the aspirator opening area must be approximately the size of the advancing filament in order to develop sufficient aspiration force from conveniently available air pressures of about 100 psig. The relatively small size of the aspirator opening, however, can cause problems because the advancing the filament flutters and wobbles as it comes off the casting wheel and may not enter the aspirator without interference with the aspirator inlet walls. Thus, there is a greater chance of choking or entanglement occuring at the aspirator inlet. Greater air pressure may be applied to reduce the chance of choking, but this requires a higher capacity air supply, involves more expensive equipment and can produce excessive noise.

Another method and apparatus for the string up of glassy metal filaments onto a winder, which is described in U.S. Pat. No. 4,239,187 issued to A. Boggs, et al., uses a pair of counterrotating brush rollers to capture the advancing metal filament. The roller brushes and associated motors of this apparatus, however, are expensive, and the brush rollers are not sufficiently maneuverable to make the rapid positional adjustments needed to precisely align the brush rollers with the filament which is twisting and fluttering as it advances. If the brush rollers miss capturing the leading edge of the advancing filament, a tangled mass can occur and the casting operation may need to be stopped and then restarted.

Thus, there remains a need for a string-up device which can handle a filament of a high denier range, can be maneuvered to make rapid positional adjustments and which can make multiple attempts to capture a rapidly advancing filament without having to stop and restart the forming operation.

SUMMARY OF THE INVENTION

This invention provides an aspirator apparatus for the string-up of a rapidly advancing filament, such as a glassy alloy filament, directly from a high speed, continuous forming process onto an in line winder. Such string-up is accomplished by engaging the leading portion of the rapidly advancing filament in an aspirator apparatus and then moving the configuration over the winder to lay the filament onto the winding surface. The filament is then secured to the winder by an automatically actuated cut-and-grip mechanism, and inline winding of the filament proceeds.

The apparatus includes a bottom aspirator plate and a top aspirator plate; the top plate being disposed opposite and in facing relation to said bottom plate and movable relative thereto. An actuator means selectively moves said top plate in a direction normal to said bottom plate to adjust the separation distance therebetween and selectively delimit an aspirating zone between said top and bottom plates. The aspirating zone comprises at least one aspirator inlet portion for receiving said filament, an aspirator outlet portion for exiting said filament and an aspirator jet portion for capturing, tensioning and directing said filament. A fluid jet means communicates with said aspiration jet portion to provide an aspirating jet of pressurized fluid therein, and a transport means allows movement of said apparatus to effect filament string-up.

Preferably, the top and bottom aspiration plates of the apparatus are contoured to provide an aspirating zone which has at least one convergent aspirator inlet portion and a divergent aspirator outlet portion.

The apparatus of this invention provides an inexpensive and light weight aspirator that can be easily maneuvered to reliably capture a rapidly advancing filament. This apparatus is not restricted to capturing the leading edge of an advancing filament, but has the advantage of being able to capture the filament by approaching it from the side. As a result, multiple attempts can be made to capture an advancing filament without the cost and time loss associated with stopping and restarting the casting operation. Since the size of the aspirator inlet can be increased by moving the top and bottom plates apart, the alignment of the aspirator with the advancing filament is non critical, and choking and entanglement of the filament at the inlet is eliminated without using excessively high aspirator air pressures. Then, maximum aspirating force can be obtained by selectively reducing the separation between the top and bottom plates.

Thus, the invention provides a string-up apparatus that is less expensive but more versatile, manueverable and reliable than conventional aspirator or roller brush string-up devices. In contrast to ordinary string-up devices, the apparatus can capture filaments of higher denier range without choking and can make multiple attempts to capture the filament without having to stop and restart the casting or forming operation.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Although the preferred embodiments of the invention will be described in relation to the capturing and transporting of a rapidly advancing metal strip, it is readily apparent that the invention is not limited to such use but may be used to capture and transport any type of advancing filament, such as textile fiber, wire, plastic strip and the like.

Figure 1:
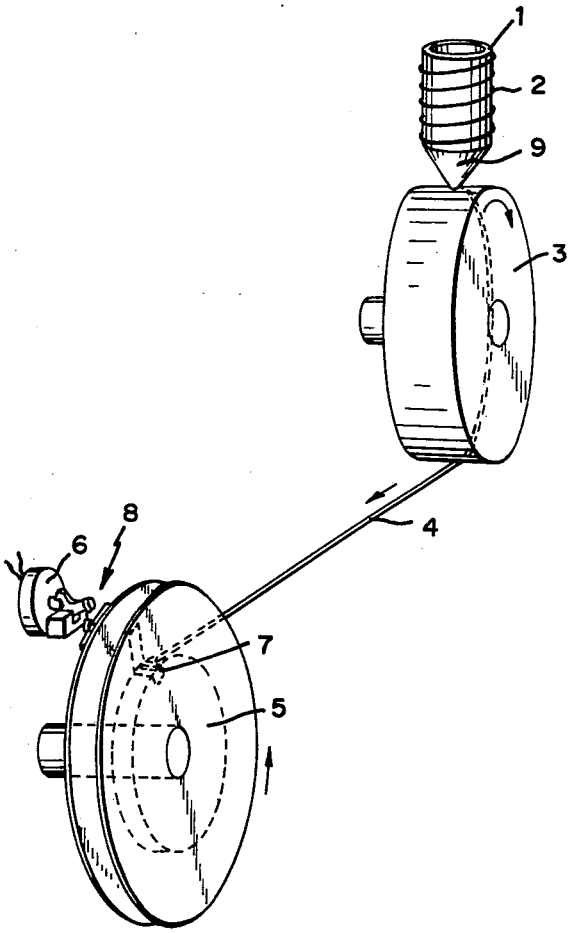
FIG. 1 shows typical prior art apparatus for the continuous casting and in line winding of glassy alloy filaments, wherein molten alloy is extruded through a nozzle onto a quench roll with a solidified filament being wound directly onto a winding wheel.
Figure 2:
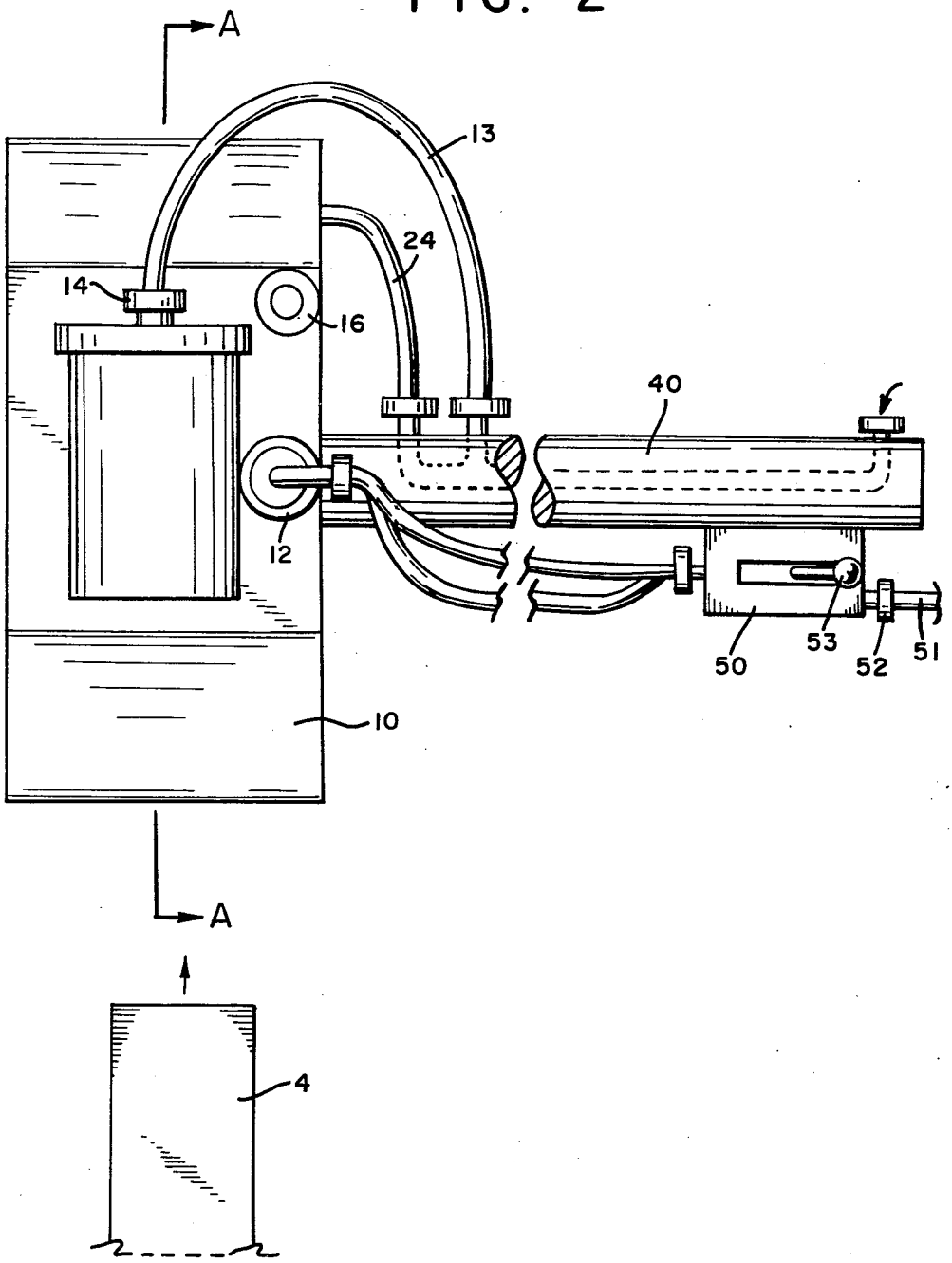
FIG. 2 is a top plan view of the apparatus of the invention.
Figure 3:
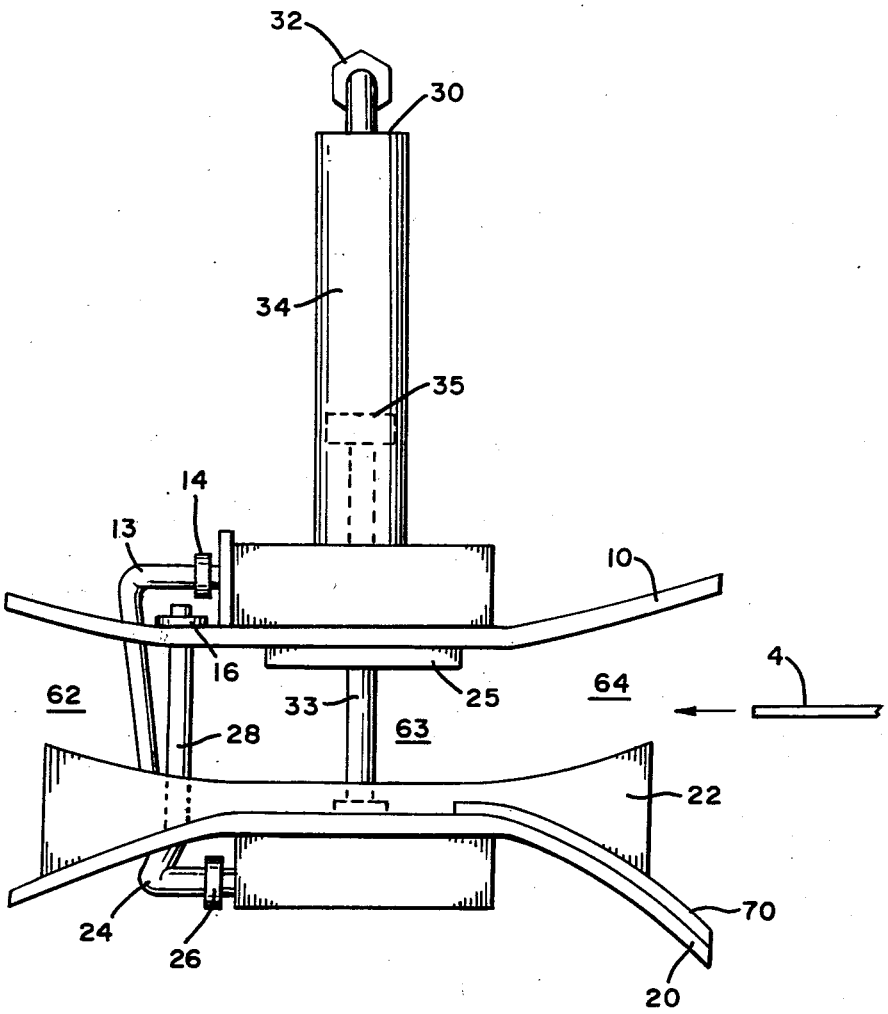
FIG. 3 is a side view of the apparatus.
Figure 4:
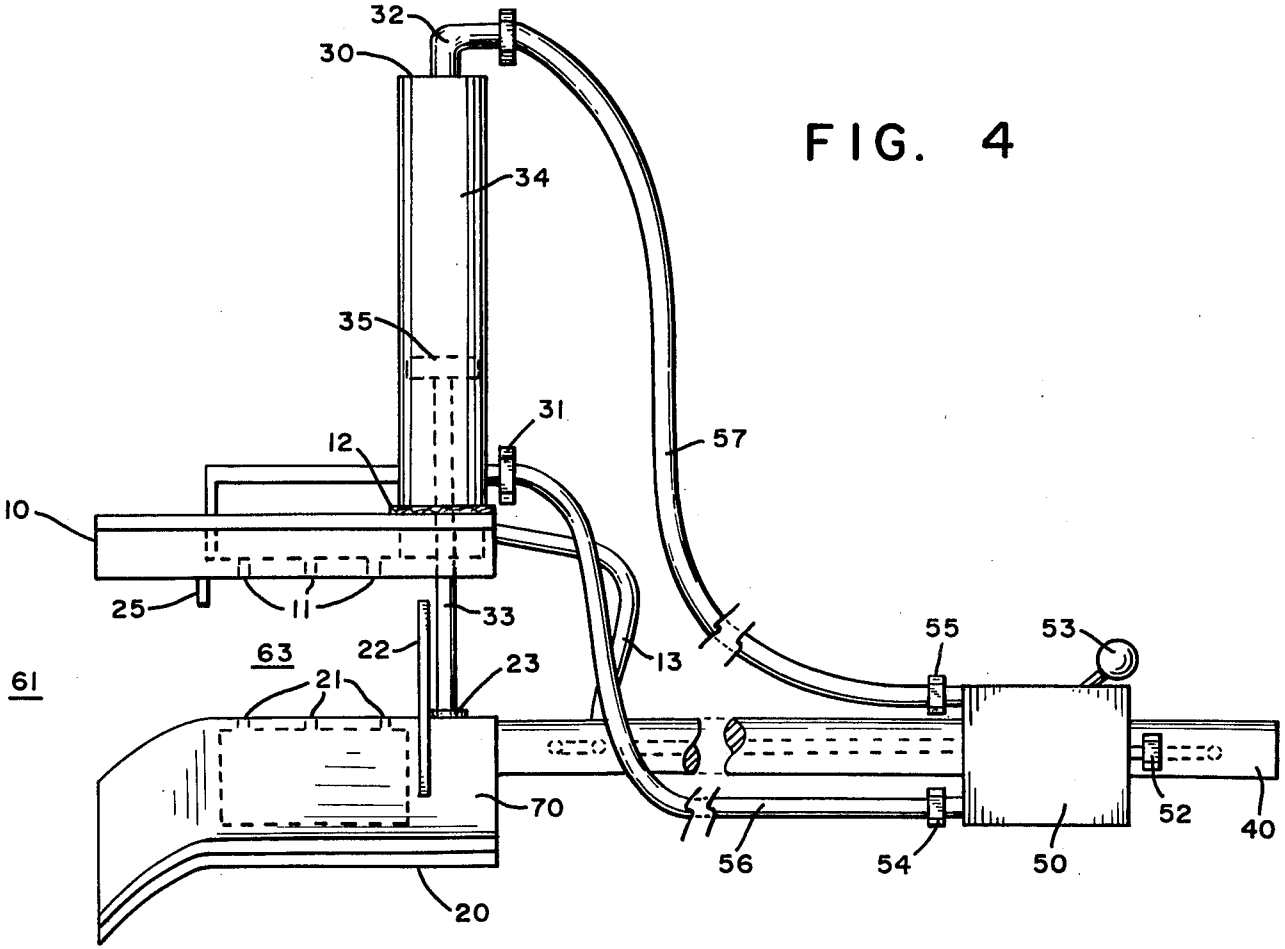
FIG. 4 is a front view of the invention.
Figure 5:
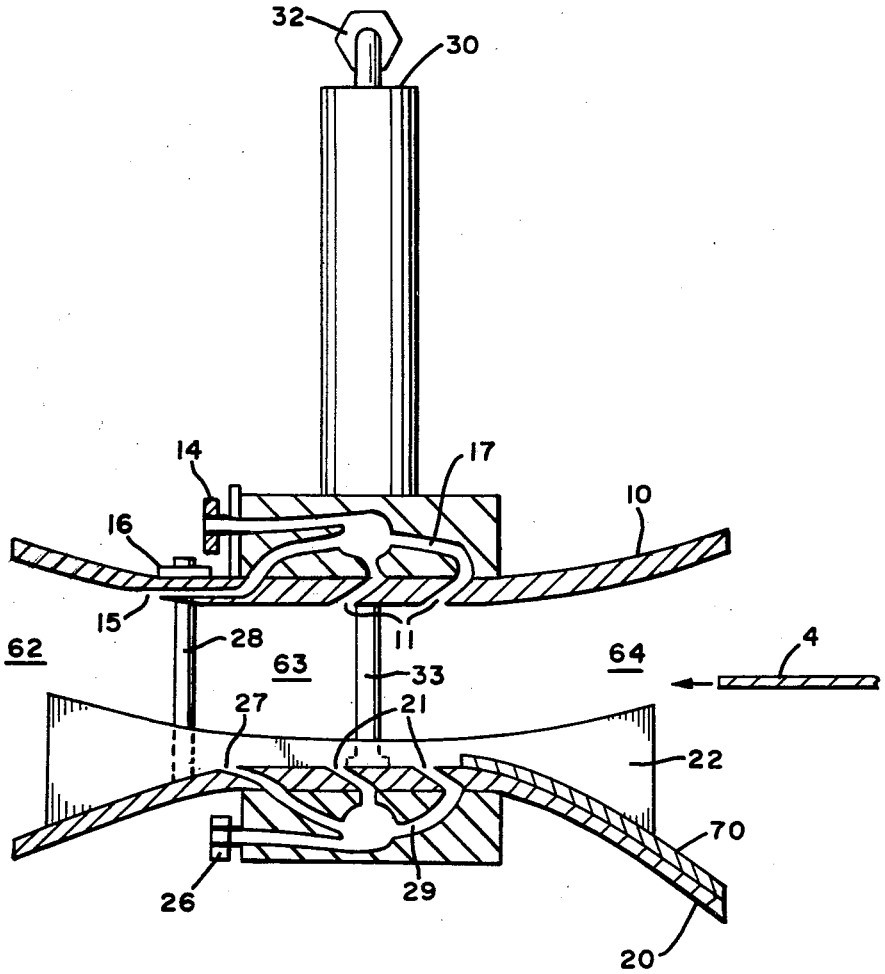
FIG. 5 is a sectional view taken along A—A of FIG. 2.

Referring specifically to the drawings in FIG. 1, representative prior art apparatus for the continuous casting of a glassy alloy filament is illustrated to point out the general use of the present invention. Molten alloy is contained in a crucible 1 is heated by a heating element 2. Pressurization of the crucible with an inert gas causes a molten stream to be extruded through a nozzle 9 at the base of the crucible onto a rotating quench wheel 3. The solidified, moving filament 4 after its breakway point from the quench wheel is routed onto a winding wheel 5, which may be provided with a torque controller (not shown) to regulate the winding tension exerted on the filament.

To initiate winding, the filament can be strung up by utilizing an aspirator (not shown) whereby the advancing filament is drawn through an aspirating nozzle. An operator then manipulates the aspirator to lay the advancing filament onto a winder, such as the core of a winding wheel, rotating at a speed approximately matching that of the advancing filament. A trigger device 6 such as a photoelectric sensor and solenoid, then releases a spring loaded, pivotal gripping element 7 associated with the winding wheel to cut and secure the advancing filament 4 to the wheel 5, whereupon winding proceeds in line with the casting process. Representative examples of such apparatus are shown in U.S. Pat. No. 4,116,394 "Moving Filament Gripping Mechanism" issued Sept. 26, 1978 to R. Smith et al., hereby incorporated by reference. When winding wheel is filled, the advancing filament may be cut and transferred to an empty rotating winder by a conventional transfer device (not shown).

Winder string up of an advancing glassy alloy filament using conventional aspirators is especially difficult and tedious due to the high speed of the filament, typically up to 2,200 meters per minute. Speeds of this magnitude are frequently a necessary part of a practical casting operation in order to achieve the extreme quench rate required to produce an amorphous alloy.

FIGS. 2, 3, 4 and 5 provide a top plan view, a side view, a front view and a sectional view, respectively, of an embodiment of the present invention. The aspirator apparatus of this invention comprises a bottom aspirator plate 20 and a top aspirator plate 10 which is disposed opposite and in facing relation to bottom plate 20 and is moveable relative thereto.

An actuator means 30 selectively moves top plate 10 in a direction normal to bottom plate 20 to adjust the separation distance and selectively delimit an aspiration zone therebetween. The aspiration zone has a front inlet 64, an alternative side inlet 61, an outlet 62 and a jet portion 63. Fluid jet means, comprised of at least one, but preferably a plurality of jet openings located along the inside surfaces of top plate 10 and bottom plate 20, communicate into jet portion 63 to provide aspirating jets of pressurized fluid therein. A positioning means, such as handle 40, allows maneuvering and transporting of the apparatus to effect ribbon string-up.

The bottom aspirator plate 20 is attached to handle 40, and has a fluid inlet passage 26 which is connected by hose 24 to a suitable supply of pressurized fluid, such as pressurized air. Pressurized air is directed from inlet 26 through suitable passageways 29 to fluid jet means comprised of a plurality of aspirator jet openings 21 and 27 arranged over the inside surface of bottom plate 20 to provide a suitable aspirating force vector. For example, in the shown embodiment, aspirator jets 21 are disposed with an entrance angle of approximately 15° to 30° from the surface of plate 20 to provide a capturing, tensioning and directing force. Aspirator jets 27 are disposed at approximately 0° from the surface of plate 20 to provide air jets that direct and lift filament 4 to reduce friction with bottom plate 20. Side plate 22 is disposed approximately perpendicular to bottom plate 20 and parallel to the direction in which filament 4 advances. Side plate 22 provides a down-stop limit when top plate 10 is moved relative to bottom plate 20 and also delimits one side of the aspirator zone when top plate 10 is moved down to its minimum separation distance from bottom plate 20. A vertical alignment rod 28 is attached to bottom plate 20 and slideably connects with top plate 10.

A friction reducing means, comprising a layer 70 composed of a friction reducing material, such as PTFE (polytetrafluoroethylene), is connected to bottom plate 20 to reduce friction with filament 4.

Top plate 10 is disposed opposite and in facing relation to bottom plate 20. Bushing 16 located in top plate 10 slideably engages rod 28 to restrain the lateral, sideways movement of top plate 10 relative to bottom plate 20, but still allow axial movement of top plate 10 along rod 28. Inlet 14 is connected by means of hose 13 to a suitable pressurized air supply. Pressurized air is directed from inlet 14 through suitable passageways 17 to additional fluid jet means comprised of a plurality of aspirator jets 11 and 15 which are arranged over the inside surface of plate 10 to provide a suitable aspirating force vector. For example, in the shown embodiment, aspirator jets 11 have an entry angle of approximately 15° to 30° from the surface of top plate 10, and aspiration jets 15 have an entry angle of approximately 0° from the surface of top plate 10.

Preferably plates 10 and 20 are made of an inexpensive, lightweight material such as plastic or sheet metal.

Actuator means 30 in the shown embodiment is a gas operated piston-cylinder assembly comprising piston 35, cylinder 34, rod 33 and control valve 50. Cylinder 34 is connected to top plate 10, piston 35 slides inside cylinder 34, and rod 33 connects piston 35 to bottom plate 20. When activated, actuator 30 moves plate 10 in a direction substantially normal to the facing surface of plate 20 to adjust the separation distance therebetween.

A fluid control means comprised of control valve 50 is mounted at a suitable location, such as on handle 40. Valve inlet 52 is connected by hose 51 to a suitable pressurized air supply, and valve control handle 53 provides a means for selectively directing pressurized air to valve outlets 54 and 55. Valve outlet 54 directs pressurized air through hose 56 to actuator inlet 31 to selectively decrease the separation distance between top plate 10 and bottom plate 20. Valve outlet 55 directs pressurized air through hose 57 to actuator inlet 32 to selectively increase the distance between top plate 10 and bottom plate 20. Thus, control valve 50 controls actuator 30 to selectively adjust the separation distance between top plate 10 and bottom plate 20. In the shown embodiment the maximum separation distance between top plate 10 and bottom plate 20 is approximately 5 centimeters, and the minimum separation distance is approximately 0.76 centimeters.

It is readily apparent that many other types of actuator mechanisms could be used in this apparatus. For example, various types of motorized actuators and associated control means could be adapted for use as well as other types of fluid operated mechanisms, all of which are within the scope of this invention.

Top plate 10, bottom plate 20 and side plate members 22 and 25 delimit an aspiration zone having a front inlet 64 to receive moving filament 4, an alternate side inlet 61 to receive filament 4, outlet 62 to exit filament 4 and a jet portion 63 to capture, tension and direct filament 4. Top plate 10 and bottom plate 20 are suitably dimensioned to accommodate the desired filament size, and sufficient aspirator jets are provided and arranged to communicate with jet portion 63 to develop the desired aspiration force vector. Preferrably, top plate 10 and bottom plate 20 are contoured to delimit convergent inlets 64 and 61 and to delimit a divergent outlet 62. In the shown embodiment, bottom plate 20 is contoured downward through an angle of approximately 26° at inlets 61 and 64, and is contoured downward through an angle of approximately 23.4° at outlet 62. Similarly, top plate 10 is contoured upwards at front inlet 64 and is contoured upwards at outlet 62.

During operation, pressurized air at approximately 100 psig is supplied to aspirator jets 11, 14, 21 and 27 to produce air jet speeds of about 750 mph. The volume of air flow required depends upon the filament geometry, density and speed. Actuator 30 is activated to move top plate 10 to its maximum separation distance from bottom plate 20. When the filament casting operation begins and the filament advances off the casting wheel, the aspirator apparatus is manipulated by means of handle 40 to approach filament 4. Filament 4 slides into the aspirator by way of front inlet 64 or side inlet 61. Filament 4 then continues to advance through front inlet 64, remains captured and directed through jet zone 63 and exits through outlet 62. If the apparatus does not capture filament 4 on the first attempt, or if filament 4 tangles and chokes the inlet, the apparatus can be withdrawn away from the filament to clear any entanglements. The apparatus can then reapproach filament 4 from the side for another capture attempt by way of side inlet 61 without having to stop the casting operation.

Actuator 30 is then activated to move top plate 10 to its minimum separation distance from bottom plate 20 to develop a maximum aspirating force from the aspirator jets. Side plate 22 is generally sufficient to guide and position filament 4 sideways within the aspirator, but another side plate 25 may also be incorporated to help position filament 4 if desired. The apparatus along with captured filament 4 is then carried to winding wheel 5 where filament 4 is attached for inline winding.

Having thus described the invention in rather full detail, it will be understood that these details need not be strictly adhered to but that various changes and modifications may suggest themselves to one skilled in the art, all falling within the scope of the invention as defined by the subjoined claims.

I claim:

1. An apparatus for the inline string-up of a rapidly advancing filament from a continuous forming operation onto an inlet winder, comprising:

a. a bottom aspirator plate;

b. a top aspirator plate disposed opposite and in facing relation to said bottom plate and moveable relative thereto;

c. an actuator means for selectively moving said top plate in a direction normal to said bottom plate to adjust the separation therebetween and selectively delimit an aspiration zone between said top and bottom plates, said zone comprising at least one filament inlet portion for receiving said filament, a filament outlet portion for exiting said filament and an aspiration jet portion for capturing, tensioning and directing said filament;

d. a fluid jet means located on inside facing surfaces of said top and bottom aspirator plates and in communication with said aspiration jet portion for providing an aspirating jet of pressurized fluid therein; and e. a transport means for moving said apparatus to effect filament string-up.

2. The apparatus as recited in claim 1, wherein said top and bottom aspirator plates are contoured to provide an aspirating zone having at least one convergent aspirator filament inlet portion and a divergent aspirator filament outlet portion.

3. The apparatus as recited in claim 1, wherein said actuator means comprises a fluid control means for selectively admitting pressurized fluid into a fluid operated piston-cylinder actuator assembly, said assembly being connected to move said top and bottom plates relative to each other changing the separation distance therebetween.

4. The apparatus as recited in claim 1, further comprising at least one side plate connected to one of said aspirator plates, said side plate being disposed substantially perpendicular to said aspirator plate and substantially parallel to the direction of advancement of said filament to position said filament within the apparatus.

5. The apparatus as recited in claim 1 wherein said pressurized fluid is air.

6. The apparatus as recited in claim 1 wherein said aspiration zone comprises a front filament inlet portion, a side filament inlet portion, a filament outlet portion and an aspiration jet portion.

7. The apparatus as recited in claim 1, wherein said fluid jet means comprises a plurality of jet openings disposed on the inside surfaces of said top and bottom aspirator plates.

8. The apparatus as recited in claim 1, further comprising a friction reducing means connected to the inside surface of at least one of said aspirator plates.

9. The apparatus as recited in claim 8, wherein said friction reducing means comprises a layer of PTFE (polytetrafluoroethylene).

* * * * *

UNITED STATES PATENT AND TRADEMARK OFFICE

CERTIFICATE OF CORRECTION

PATENT NO. : 4,450,997

DATED : May 29, 1984

INVENTOR(S) : Hsin L. Li .

It is certified that error appears in the above-identified patent and that said Letters Patent are hereby corrected as shown below:

Col. 6, line 41, "inlet" should read --inline--

Signed and Sealed this

Second Day of October 1984

[SEAL]

*Attest:*

GERALD J. MOSSINGHOFF

*Attesting Officer*

*Commissioner of Patents and Trademarks*